US012618160B2

(12) United States Patent
Farandos et al.

(10) Patent No.: US 12,618,160 B2
(45) Date of Patent: May 5, 2026

(54) ELECTROCHEMICAL PRODUCER FOR HYDROGEN OR CARBON MONOXIDE

(71) Applicant: Utility Global, Inc., Houston, TX (US)

(72) Inventors: Nicholas Farandos, Bray (IE); Matthew Dawson, Katy, TX (US); Jin Dawson, Katy, TX (US); Jason Dana, Woodlands, TX (US); Thomas Stilson, Katy, TX (US)

(73) Assignee: Utility Global, Inc., Houston, TX (US)

( * ) Notice: Subject to any disclaimer, the term of this patent is extended or adjusted under 35 U.S.C. 154(b) by 775 days.

(21) Appl. No.: 18/074,747

(22) Filed: Dec. 5, 2022

(65) Prior Publication Data

US 2023/0175143 A1 Jun. 8, 2023

Related U.S. Application Data

(60) Provisional application No. 63/289,421, filed on Dec. 14, 2021, provisional application No. 63/286,974, filed on Dec. 7, 2021.

(51) Int. Cl.
*C25B 1/04* (2021.01)
*C25B 1/23* (2021.01)
(Continued)

(52) U.S. Cl.
CPC ..... *C25B 1/04* (2013.01); *C25B 1/23* (2021.01); *C25B 9/23* (2021.01); *C25B 9/30* (2021.01);
(Continued)

(58) Field of Classification Search
CPC .... C25B 1/04; C25B 1/23; C25B 9/23; C25B 9/30; C25B 11/033; C25B 11/067;
(Continued)

(56) References Cited

U.S. PATENT DOCUMENTS 6,287,432 B1 9/2001 Mazanec et al.
10,596,544 B2 3/2020 Motoshige et al.
(Continued)

FOREIGN PATENT DOCUMENTS

EP 2 450 994 A1 5/2012
KR 101392828 B1 * 5/2014 ..... C25B 13/04
(Continued)

OTHER PUBLICATIONS

Machine translation of KR-101392828-B1.*
(Continued)

*Primary Examiner* — Bryan D. Ripa
(74) *Attorney, Agent, or Firm* — Foley & Lardner LLP

(57) ABSTRACT

Herein discussed is an electrochemical reactor comprising a first electrode, wherein the first electrode is liquid when the reactor is in operation; a second electrode having a metallic phase and a ceramic phase, wherein the metallic phase is electronically conductive and wherein the ceramic phase is ionically conductive; and a membrane, wherein the membrane is positioned between the first and second electrodes and is in contact with the first and second electrodes, wherein the membrane is mixed conducting. Also discussed herein is a method of producing hydrogen or carbon monoxide comprising: (a) providing an electrochemical reactor having an anode, a cathode, and a membrane between the anode and the cathode, wherein the anode is liquid when the reactor is in operation and wherein the membrane is mixed conducting; (b) introducing a feedstock to the anode; (c) introducing a stream to the cathode, wherein the stream comprises water or carbon dioxide.

14 Claims, 3 Drawing Sheets

(51) Int. Cl.

| | |
|---|---|
| ***C25B 9/23*** | (2021.01) |
| ***C25B 9/30*** | (2021.01) |
| ***C25B 11/033*** | (2021.01) |
| ***C25B 11/067*** | (2021.01) |
| ***C25B 11/077*** | (2021.01) |
| ***C25B 13/04*** | (2021.01) |

(52) U.S. Cl.
CPC ..... *C25B 11/033* (2021.01); *C25B 11/067* (2021.01); *C25B 11/077* (2021.01); *C25B 13/04* (2013.01)

(58) Field of Classification Search
CPC ..... C25B 11/077; C25B 13/04; C25B 5/00; C25B 9/015; C25B 9/305; C25B 11/031; C25B 11/04; C25B 13/05; C25B 13/07; Y02E 60/36
See application file for complete search history.

(56) References Cited

U.S. PATENT DOCUMENTS

| | | | |
|---|---|---|---|
| 2007/0163889 | A1 | 7/2007 | Kato et al. |
| 2009/0071841 | A1* | 3/2009 | Pal ..... H01M 8/1246 429/418 |
| 2010/0297537 | A1 | 11/2010 | Coors et al. |
| 2012/0048730 | A1 | 3/2012 | Hartvigsen et al. |
| 2013/0026032 | A1 | 1/2013 | Pal et al. |
| 2013/0062215 | A1 | 3/2013 | Kurashina et al. |
| 2015/0118592 | A1 | 4/2015 | Allebrod et al. |
| 2015/0299871 | A1 | 10/2015 | Chen et al. |
| 2020/0140297 | A1 | 5/2020 | Hall et al. |
| 2020/0144627 | A1 | 5/2020 | Hall et al. |
| 2020/0144628 | A1 | 5/2020 | Hall et al. |
| 2020/0144633 | A1 | 5/2020 | Hall et al. |
| 2020/0144635 | A1 | 5/2020 | Hall et al. |
| 2020/0144646 | A1 | 5/2020 | Hall et al. |
| 2020/0144647 | A1 | 5/2020 | Hall et al. |
| 2020/0144648 | A1 | 5/2020 | Hall et al. |
| 2020/0144653 | A1 | 5/2020 | Hall et al. |
| 2020/0144654 | A1 | 5/2020 | Hall et al. |
| 2020/0156104 | A1 | 5/2020 | Hall et al. |
| 2020/0176803 | A1 | 6/2020 | Hall et al. |
| 2020/0182549 | A1 | 6/2020 | Hall et al. |
| 2020/0227763 | A1 | 7/2020 | Hall et al. |
| 2020/0235409 | A1 | 7/2020 | Hall et al. |
| 2020/0235410 | A1 | 7/2020 | Hall et al. |
| 2020/0255959 | A1 | 8/2020 | Hall et al. |
| 2020/0255962 | A1 | 8/2020 | Hall et al. |
| 2020/0255963 | A1 | 8/2020 | Hall et al. |
| 2020/0259186 | A1 | 8/2020 | Hall et al. |
| 2020/0303749 | A1 | 9/2020 | Hall et al. |
| 2021/0024425 | A1 | 1/2021 | Dawson et al. |
| 2021/0069786 | A1 | 3/2021 | Hall et al. |
| 2021/0121978 | A1 | 4/2021 | Dawson et al. |
| 2021/0175531 | A1 | 6/2021 | Farandos et al. |
| 2022/0305437 | A1 | 9/2022 | Ho et al. |
| 2022/0364245 | A1 | 11/2022 | Farandos et al. |
| 2022/0364251 | A1 | 11/2022 | Dawson et al. |
| 2022/0372635 | A1 | 11/2022 | Farandos et al. |
| 2022/0380210 | A1 | 12/2022 | Farandos et al. |
| 2022/0403532 | A1 | 12/2022 | Farandos et al. |
| 2023/0002915 | A1 | 1/2023 | Dawson et al. |
| 2023/0013911 | A1 | 1/2023 | Dawson et al. |
| 2023/0020427 | A1 | 1/2023 | Farandos et al. |
| 2023/0092683 | A1 | 3/2023 | Farandos et al. |
| 2023/0109683 | A1 | 4/2023 | Dawson et al. |
| 2023/0167560 | A1 | 6/2023 | Dawson et al. |
| 2024/0133052 | A1 | 4/2024 | Matthews et al. |
| 2024/0133062 | A1 | 4/2024 | Dawson et al. |
| 2024/0167169 | A1 | 5/2024 | Dawson et al. |
| 2024/0200210 | A1 | 6/2024 | Dawson |
| 2024/0209530 | A1 | 6/2024 | Dawson et al. |
| 2024/0229253 | A9 | 7/2024 | Matthews et al. |
| 2024/0287688 | A1 | 8/2024 | Dawson et al. |
| 2024/0287689 | A1 | 8/2024 | Dawson et al. |
| 2024/0417867 | A1 | 12/2024 | Dawson et al. |
| 2024/0417869 | A1 | 12/2024 | Dawson et al. |
| 2025/0011945 | A1 | 1/2025 | Dawson et al. |
| 2025/0146147 | A1 | 5/2025 | Dawson |
| 2025/0236962 | A1 | 7/2025 | Dawson et al. |

FOREIGN PATENT DOCUMENTS

| | | | |
|---|---|---|---|
| WO | WO-2016/205303 | A1 | 12/2016 |
| WO | WO-2020/146754 | A1 | 4/2020 |
| WO | WO-2020/172111 | A1 | 8/2020 |

OTHER PUBLICATIONS

"Enhanced Electrical Conductivity in Ce0.79Gd0.20Co0.01O2-δ for Low Temperature Solid Oxide Fuel Cell Applications" by Dutta et al., Electrochem. Comm. 11, pp. 699-701 (2009).*

Deibert, W. et al., 'Ion-conducting ceramic membrane reactors for high-temperature applications', Journal of membrane science, 2017, vol. 543, pp. 79-97.

International Search Report and Written Opinion for PCT/US2022/051391 mailed Apr. 7, 2023.

International Search Report and Written Opinion for PCT/US2022/051784 dated Apr. 18, 2023.

Li Haomiao et al., "Liquid metal electrodes for energy storage batteries", Advanced Energy Materials, vol. 6, Jul. 20, 2016 (Jul. 20, 2016), p. 1600483, XP93290587, 19 pgs.

* cited by examiner

ELECTROCHEMICAL PRODUCER FOR HYDROGEN OR CARBON MONOXIDE

CROSS-REFERENCE TO RELATED APPLICATIONS

This application claims the benefit under 35 U.S.C. 119(e) of U.S. Provisional Patent Application No. 63/286,974 filed Dec. 7, 2021 and Application No. 63/289,421 filed Dec. 14, 2021, the entire disclosures of which are hereby incorporated herein by reference.

TECHNICAL FIELD

This invention generally relates to production of hydrogen ($H_2$) or carbon monoxide (CO). More specifically, this invention relates to electrochemical production of hydrogen ($H_2$) or carbon monoxide (CO).

BACKGROUND

Carbon monoxide (CO) is a colorless, odorless, tasteless, and flammable gas that is slightly less dense than air. It is well known for its poisoning effect because CO readily combines with hemoglobin to produce carboxyhemoglobin, which is highly toxic when the concentration exceeds a certain level. However, CO is a key ingredient in many chemical and industrial processes. CO has a wide range of functions across all disciplines of chemistry, e.g., metal-carbonyl catalysis, radical chemistry, cation and anion chemistries. Carbon monoxide is a strong reductive agent and has been used in pyrometallurgy to reduce metals from ores for centuries. As an example for making specialty compounds, CO is used in the production of vitamin A.

Hydrogen ($H_2$) in large quantities is needed in the petroleum and chemical industries. For example, large amounts of hydrogen are used in upgrading fossil fuels and in the production of methanol or hydrochloric acid. Petrochemical plants need hydrogen for hydrocracking, hydrodesulfurization, hydrodealkylation. Hydrogenation processes to increase the level of saturation of unsaturated fats and oils also need hydrogen. Hydrogen is also a reducing agent of metallic ores. Hydrogen may be produced from electrolysis of water, steam reforming, lab-scale metal-acid process, thermochemical methods, or anaerobic corrosion. Many countries are aiming at a hydrogen economy.

In the Fischer-Tropsch process, CO and $H_2$ are both essential building blocks, which are often produced by converting carbon-rich feedstocks (e.g., coal). A mixture of CO and $H_2$—syngas can combine to produce various liquid fuels, e.g., via the Fischer-Tropsch process. Syngas can also be converted to lighter hydrocarbons, methanol, ethanol, or plastic monomers (e.g., ethylene). The ratio of $CO/H_2$ is important in all such processes in order to produce the desired compounds. Conventional techniques require extensive and expensive separation and purification processes to obtain the CO and $H_2$ as building blocks.

Clearly there is increasing need and interest to develop new technological platforms to produce these building blocks and valuable products. This disclosure discusses production of valuable products via efficient electrochemical pathways. Furthermore, the method and system as disclosed herein do not require the extensive and expensive separation and purification processes as needed in traditional technologies.

SUMMARY

Herein discussed is an electrochemical reactor comprising a first electrode, wherein the first electrode is liquid when the reactor is in operation; a second electrode having a metallic phase and a ceramic phase, wherein the metallic phase is electronically conductive and wherein the ceramic phase is ionically conductive; and a membrane, wherein the membrane is positioned between the first and second electrodes and is in contact with the first and second electrodes, wherein the membrane is mixed conducting.

In an embodiment, the second electrode comprises Ni or NiO and a material selected from the group consisting of YSZ, CGO, SDC, SSZ, LSGM, CoCGO, and combinations thereof. In an embodiment, the second electrode is porous. In an embodiment, the second electrode is configured to reduce water to hydrogen electrochemically or to reduce carbon dioxide to carbon monoxide electrochemically. In an embodiment, the first electrode comprises tin (Sn), bismuth (Bi), cadmium (Cd), lead (Pb), antimony (Sb), indium (In), silver (Ag), babbitt metal, or combinations thereof. In an embodiment, the first electrode comprises lithium carbonate, potassium carbonate, sodium carbonate, or combinations thereof. In an embodiment, the first electrode is configured to carry a feedstock.

In an embodiment, the feedstock comprises carbon, ammonia, syngas, hydrogen, methanol, carbon monoxide, a hydrocarbon, biodiesel, renewable natural gas, biogas, biomass, biowaste, charcoal, petcoke, cooking oil, or combinations thereof. In an embodiment, the first electrode is configured to oxidize a feedstock electrochemically. In an embodiment, the reactor comprises no interconnect and no current collector. In an embodiment, the reactor produces no electricity and receives no electricity.

In an embodiment, the membrane comprises an electronically conducting phase and an ionically conducting phase. In an embodiment, the electronically conducting phase comprises doped lanthanum chromite or an electronically conductive metal or combination thereof; and wherein the ionically conducting phase comprises a material selected from the group consisting of gadolinium or samarium doped ceria, yttria-stabilized zirconia (YSZ), lanthanum strontium gallate magnesite (LSGM), scandia-stabilized zirconia (SSZ), Sc and Ce doped zirconia (SCZ), and combinations thereof.

In an embodiment, the membrane comprises CoCGO or LST (lanthanum-doped strontium titanate)-stabilized zirconia. In an embodiment, the stabilized zirconia comprises YSZ or SSZ or SCZ (scandia-ceria-stabilized zirconia), and wherein the LST comprises $LaSrCaTiO_3$. In an embodiment, the membrane comprises Nickel, Copper, Cobalt, or Niobium-doped zirconia.

Also discussed herein is a method of producing hydrogen or carbon monoxide comprising: (a) providing an electrochemical reactor having an anode, a cathode, and a membrane between the anode and the cathode, wherein the anode is liquid when the reactor is in operation and wherein the membrane is mixed conducting; (b) introducing a feedstock to the anode; (c) introducing a stream to the cathode, wherein the stream comprises water or carbon dioxide. In an embodiment, the anode and the cathode are both exposed to reducing environments during the entire time of operation. In an embodiment, the anode comprises tin (Sn), bismuth (Bi), cadmium (Cd), lead (Pb), antimony (Sb), indium (In), silver (Ag), babbitt metal, or combinations thereof. In an embodiment, the anode comprises lithium carbonate, potassium carbonate, sodium carbonate, or combinations thereof.

Further aspects and embodiments are provided in the following drawings, detailed description, and claims. Unless specified otherwise, the features as described herein are combinable and all such combinations are within the scope of this disclosure.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions.

The drawings are not necessarily drawn to scale; in some instances, certain elements of the drawing may be enlarged with respect to other elements of the drawing for purposes of illustration.

DETAILED DESCRIPTION

Overview

Figure 1:
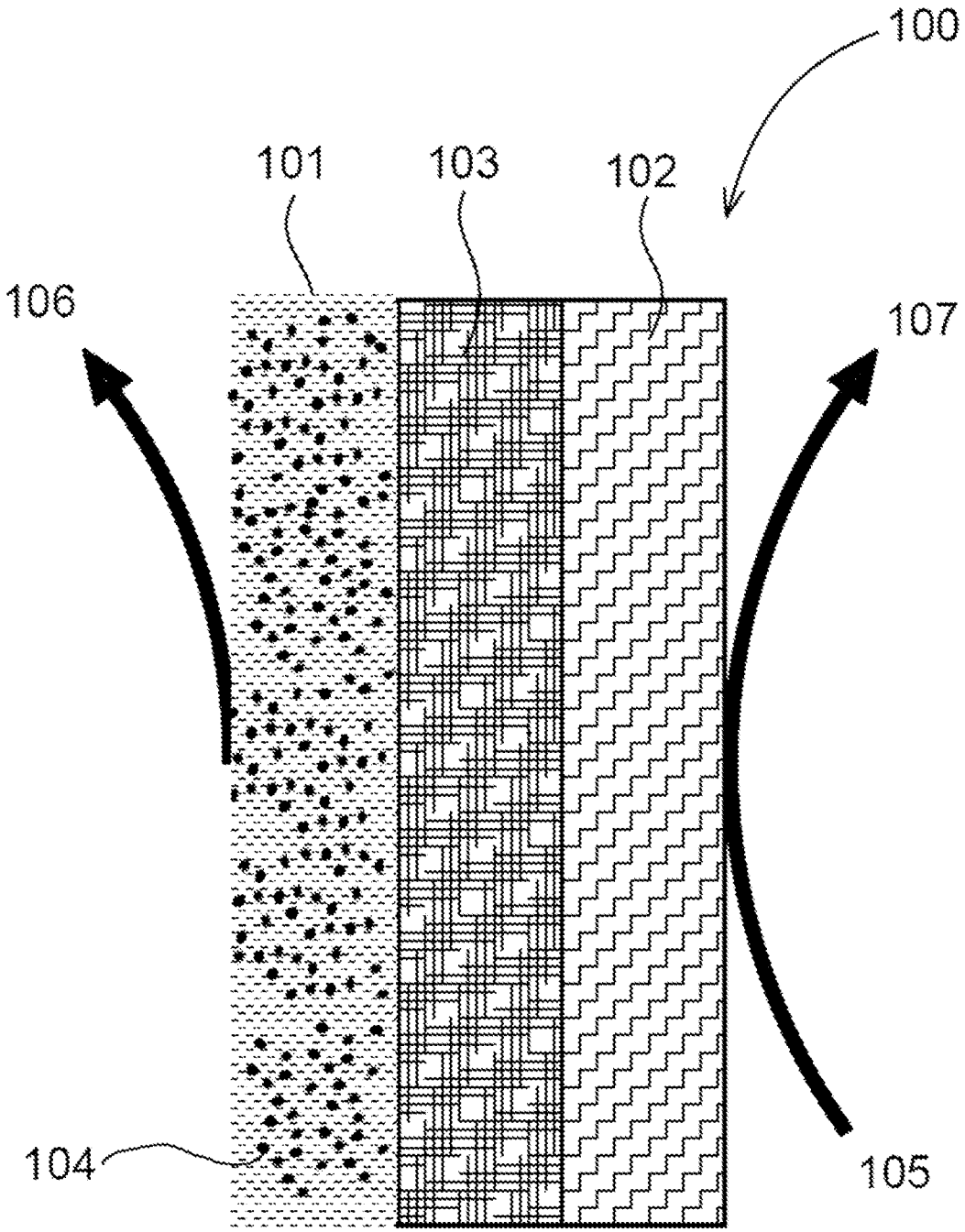
FIG. 1 illustrates an electrochemical (EC) reactor or an electrochemical producer for producing $H_2$ or CO, according to an embodiment of this disclosure.

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like. As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, compositions and materials are used interchangeably unless otherwise specified. Each composition/material may have multiple elements, phases, and components. Heating as used herein refers to actively adding energy to the compositions or materials.

As used herein, YSZ refers to yttria-stabilized zirconia; SDC refers to samaria-doped ceria; SSZ refers to scandia-stabilized zirconia; LSGM refers to lanthanum strontium gallate magnesite.

In this disclosure, no substantial amount of $H_2$ means that the volume content of the hydrogen is no greater than 5%, or no greater than 3%, or no greater than 2%, or no greater than 1%, or no greater than 0.5%, or no greater than 0.1%, or no greater than 0.05%.

As used herein, CGO refers to Gadolinium-Doped Ceria, also known alternatively as gadolinia-doped ceria, gadolinium-doped cerium oxide, cerium(IV) oxide, gadolinium-doped, GDC, or GCO, (formula Gd:$CeO_2$). CGO and GDC are used interchangeably unless otherwise specified. Syngas (i.e., synthesis gas) in this disclosure refers to a mixture consisting primarily of hydrogen, carbon monoxide and carbon dioxide.

A mixed conducting membrane is able to transport both electrons and ions. Ionic conductivity includes ionic species such as oxygen ions (or oxide ions), protons, halogenide anions, chalcogenide anions. In various embodiment, the mixed conducting membrane of this disclosure comprises an electronically conducting phase and an ionically conducting phase.

In this disclosure, the axial cross section of the tubulars is shown to be circular, which is illustrative only and not limiting. The axial cross section of the tubulars is any suitable shape as known to one skilled in the art, such as square, square with rounded corners, rectangle, rectangle with rounded corners, triangle, hexagon, pentagon, oval, irregular shape, etc.

As used herein, ceria refers to cerium oxide, also known as ceric oxide, ceric dioxide, or cerium dioxide, is an oxide of the rare-earth metal cerium. Doped ceria refers to ceria doped with other elements, such as samaria-doped ceria (SDC), or gadolinium-doped ceria (GDC or CGO). As used herein, chromite refers to chromium oxides, which includes all the oxidation states of chromium oxides.

A layer or substance being impermeable as used herein refers to it being impermeable to fluid flow. For example, an impermeable layer or substance has a permeability of less than 1 micro darcy, or less than 1 nano darcy.

In this disclosure, sintering refers to a process to form a solid mass of material by heat or pressure, or a combination thereof, without melting the material to the extent of liquefaction. For example, material particles are coalesced into a solid or porous mass by being heated, wherein atoms in the material particles diffuse across the boundaries of the particles, causing the particles to fuse together and form one solid piece.

The term "in situ" in this disclosure refers to the treatment (e.g., heating or cracking) process being performed either at the same location or in the same device. For example, ammonia cracking taking place in the electrochemical reactor at the anode is considered in situ.

Electrochemistry is the branch of physical chemistry concerned with the relationship between electrical potential, as a measurable and quantitative phenomenon, and identifiable chemical change, with either electrical potential as an outcome of a particular chemical change, or vice versa. These reactions involve electrons moving between electrodes via an electronically-conducting phase (typically, but not necessarily, an external electrical circuit), separated by an ionically-conducting and electronically insulating membrane (or ionic species in a solution). When a chemical reaction is effected by a potential difference, as in electrolysis, or if electrical potential results from a chemical reaction as in a battery or fuel cell, it is called an electrochemical reaction. Unlike chemical reactions, in electrochemical reactions electrons (and necessarily resulting ions), are not transferred directly between molecules, but via the aforementioned electronically conducting and ionically conducting circuits, respectively. This phenomenon is what distinguishes an electrochemical reaction from a chemical reaction.

Related to the electrochemical reactor and methods of use, various components of the reactor are described such as electrodes and membranes along with materials of construction of the components. The following description recites various aspects and embodiments of the inventions disclosed herein. No particular embodiment is intended to define the scope of the invention. Rather, the embodiments provide non-limiting examples of various compositions and methods that are included within the scope of the claimed inventions. The description is to be read from the perspective of one of ordinary skill in the art. Therefore, information that is well-known to the ordinarily skilled artisan is not necessarily included.

An interconnect in an electrochemical device (e.g., a fuel cell) is often either metallic or ceramic that is placed between the individual cells or repeat units. Its purpose is to connect each cell or repeat unit so that electricity can be distributed or combined. An interconnect is also referred to as a bipolar plate in an electrochemical device. An interconnect being an impermeable layer as used herein refers to it being a layer that is impermeable to fluid flow.

In this disclosure, biomass is plant or animal material used as fuel to be oxidized. Examples of biomass are wood, grass, sugar cane, rice, energy crops, and waste from forests, yards, or farms.

Electrochemical Reactor

Contrary to conventional practice, an electrochemical reactor has been discovered, which comprises a mixed-conducting membrane, wherein the reactor is capable of producing hydrogen from water electrochemically without electricity input. The reactor is also capable of producing carbon monoxide from carbon dioxide electrochemically without electricity input. The electrochemical reactions involve the exchange of oxide ions through the membrane to oxidize a fuel (e.g., carbon). The mixed-conducting membrane also conducts electrons to complete the electrochemical reactions. As such, the reactor comprises no interconnect or bipolar plate. Additionally, the reactor does not generate electricity and is not a fuel cell. In various embodiments, the electrodes have no current collector attached to them. In various embodiments, the reactor does not contain any current collector. Clearly, such a reactor is fundamentally different from any electrolysis device or any fuel cell.

The electrochemical reactions taking place in the reactor comprise electrochemical half-cell reactions. In various embodiments, the half-cell reactions take place at triple phase boundaries, wherein the triple phase boundaries are the intersections of pores with the electronically conducting phase and the ionically conducting phase. In various embodiments, the membrane is impermeable to fluid flow. In an embodiment, the reactor comprises a porous electrode that comprises metallic phase and ceramic phase, wherein the metallic phase is electronically conductive and wherein the ceramic phase is ionically conductive.

FIG. 1 illustrates an electrochemical reactor or an electrochemical (EC) producer 100 for hydrogen production, according to an embodiment of this disclosure. The EC reactor 100 comprises a first electrode 101, membrane 103, and a second electrode 102. First electrode 101, in various embodiments, is a metal or carbonate that is configured to carry, suspend, or circulate feedstock 104 when the reactor is in operation, wherein the metal or carbonate becomes liquid. The metal comprises tin (Sn), bismuth (Bi), cadmium (Cd), lead (Pb), antimony (Sb), indium (In), silver (Ag), babbitt metal, or combinations thereof. The carbonate comprises lithium carbonate, potassium carbonate, sodium carbonate, or combinations thereof.

Feedstock 104 comprises carbon, ammonia, syngas, hydrogen, methanol, carbon monoxide, a hydrocarbon, biodiesel, renewable natural gas, biogas, biomass, biowaste, charcoal, petcoke, cooking oil, or combinations thereof. Carbon may be obtained from any source known to one skilled in the art, such as petroleum coke (coke or petcoke), carbon black, char, graphite, coal, biowaste, biomass. Examples of a hydrocarbon are methane, ethane, propane, butane. In various embodiments, the volume content of solid feedstock (e.g., carbon) in the first electrode is no greater than 30 vol %. At the first electrode 101, feedstock 104 is oxidized via the oxide ions transported through the membrane 103. For example, carbon is converted to carbon monoxide or carbon dioxide (i.e., carbon oxides). Stream 106 represents exhaust from the first electrode.

Second electrode 102 is configured to receive water (e.g., steam) as denoted by 105. In an embodiment, stream 105 also contains hydrogen, wherein the amount of hydrogen is less than water. At the second electrode 102, water is electrochemically reduced to hydrogen. Stream 107 represents exhaust from the second electrode. Since water provides the oxide ion (which is transported through the membrane) needed to oxidize the feedstock at the opposite electrode, water is considered the oxidant in this scenario. As such, the first electrode 101 is performing oxidation reactions in a reducing environment; the second 102 electrode is performing reduction reactions in a reducing environment. In an embodiment, the second electrode 102 comprise Ni-YSZ or NiO-YSZ. In various embodiments, electrode 102 comprise Ni or NiO and a material selected from the group consisting of YSZ, CGO, SDC, SSZ, LSGM, CoCGO, and combinations thereof. In various embodiments, both electrodes are exposed to reducing environments during the entire time of operation.

In the embodiments wherein CO is produced, second electrode 102 is configured to receive carbon dioxide ($CO_2$) as denoted by 105. In some cases, the second electrode also receives a small amount of CO. Since $CO_2$ provides the oxide ion (which is transported through the membrane) needed to oxidize the fuel at the opposite electrode, $CO_2$ is considered the oxidant in this scenario. The reduction of $CO_2$ produces CO. As such, the first electrode 101 is performing oxidation reactions in a reducing environment; the second electrode 102 is performing reduction reactions in a reducing environment. In some cases, such environments are considered nominally reducing environments. In various embodiments, both electrodes are exposed to reducing environments during the entire time of operation.

In various embodiments, 103 represents an oxide ion conducting membrane. In an embodiment, the oxide ion conducting membrane 103 also conducts electrons. Therefore, the reactor does not contain a current collector or an interconnect. There is no need for electricity and such a reactor is not an electrolyzer. This is a major advantage of the EC reactor of this disclosure. The membrane 103 is configured to conduct electrons and as such is mixed conducting, i.e., both electronically conductive and ionically conductive. In an embodiment, the membrane 103 conducts oxide ions and electrons. In these embodiments, the electrochemical reactions at the anode and the cathode are spontaneous without the need to apply potential/electricity to the reactor.

In an embodiment, the membrane 103 comprises an electronically conducting phase containing doped lanthanum chromite or an electronically conductive metal or combination thereof; and wherein the membrane comprises an ionically conducting phase containing a material selected from the group consisting of gadolinium doped ceria (CGO), samarium doped ceria (SDC), yttria-stabilized zirconia (YSZ), lanthanum strontium gallate magnesite (LSGM), scandia-stabilized zirconia (SSZ), Sc and Ce doped zirconia, Cobalt-doped gadolinium-doped ceria (CoCGO), and combinations thereof. In an embodiment, the doped lanthanum chromite comprises strontium doped lanthanum chromite, iron doped lanthanum chromite, strontium and iron doped lanthanum chromite, lanthanum calcium chromite, or combinations thereof; and wherein the conductive metal comprises Ni, Cu, Ag, Au, Pt, Rh, Co, or combinations thereof. In an embodiment, membrane 103 comprises gadolinium doped ceria, samarium doped ceria, a sintering aid, or combinations thereof. In an embodiment, the membrane comprises CoCGO. In an embodiment, the membrane consists of CoCGO. In an embodiment, the sintering aid comprises di-valent or tri-valent transition metal ions or combinations thereof. In an embodiment, the transition metal comprises Co, Mn, Fe, Cu, or combinations thereof.

In an embodiment, the membrane comprises an electronically conducting phase and an ionically conducting phase. In some cases, the electronically conducting phase comprises doped lanthanum chromite or an electronically conductive metal or combination thereof; and wherein the ionically conducting phase comprises a material selected from the group consisting of gadolinium or samarium doped ceria, yttria-stabilized zirconia (YSZ), lanthanum strontium gallate magnesite (LSGM), scandia-stabilized zirconia (SSZ), Sc and Ce doped zirconia (SCZ), and combinations thereof. In an embodiment, the membrane comprises CoCGO or LST (lanthanum-doped strontium titanate)-stabilized zirconia. In an embodiment, the stabilized zirconia comprises YSZ or SSZ or SCZ (scandia-ceria-stabilized zirconia). In an embodiment, the LST comprises $LaSrCaTiO_3$. In an embodiment, the membrane comprises Nickel, Copper, Cobalt, or Niobium-doped zirconia.

In an embodiment, the membrane comprises cobalt-CGO (CoCGO), i.e., cobalt doped CGO. In an embodiment, the membrane consists essentially of CoCGO. In an embodiment, the membrane consists of CoCGO. In an embodiment, the membrane comprises LST (lanthanum-doped strontium titanate)-YSZ or LST-SSZ or LST-SCZ (scandia-ceria-stabilized zirconia). In an embodiment, the membrane consists essentially of LST-YSZ or LST-SSZ or LST-SCZ. In an embodiment, the membrane consists of LST-YSZ or LST-SSZ or LST-SCZ. In this disclosure, LST-YSZ refers to a composite of LST and YSZ. In various embodiments, the LST phase and the YSZ phase percolate each other. In this disclosure, LST-SSZ refers to a composite of LST and SSZ. In various embodiments, the LST phase and the SSZ phase percolate each other. In this disclosure, LST-SCZ refers to a composite of LST and SCZ. In various embodiments, the LST phase and the SCZ phase percolate each other. YSZ, SSZ, and SCZ are types of stabilized zirconia's.

In an embodiment, EC reactor 100 is configured to simultaneously produce $H_2$ or CO (in stream 107) from the second electrode 102 and carbon dioxide (in stream 106) from the first electrode 101. The generated carbon dioxide (or stream 106) is sent to a carbon capture unit for sequestration. In an embodiment, the electrode 102 and the membrane 103 are tubular (see, e.g., FIG. 2). In an embodiment, the electrode 102 and the membrane 103 are planar.

Electrochemical Production of $H_2$ or CO

Figure 2:
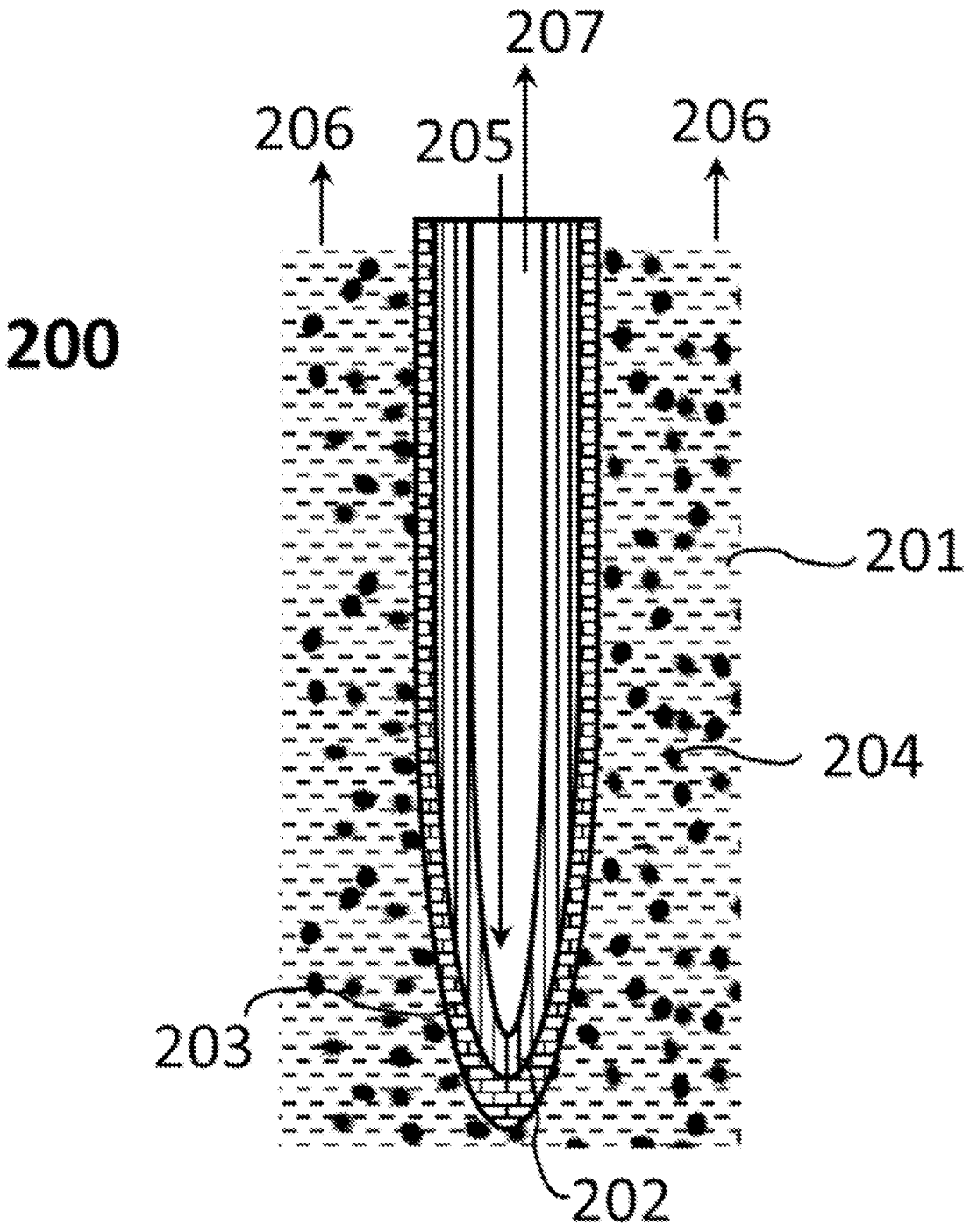
FIG. 2 illustrates a tubular configuration for the electrochemical reactor or electrochemical producer, according to an embodiment of this disclosure.

FIG. 2 illustrates (not to scale) a tubular configuration of the electrochemical (EC) reactor or an EC producer 200, according to an embodiment of this disclosure. Reactor or producer 200 includes an inner tubular structure (inner tube) 202 as an electrode, which in this case is the cathode. In various embodiments, the inner tube (cathode) is porous. Reactor or producer 200 also comprises an outer tubular structure (outer tube) 203, which is the mixed conducting membrane. In various embodiments, the membrane is impermeable to fluid flow. The inner tube 202 and the outer tube 203 are in contact with one another and immersed in liquid 201, which is the anode for reactor or producer 200. Feedstock 204 is carried in liquid 201.

Stream 205 represents water (or steam) with a small amount of hydrogen that is introduced into the inner tube 202 for hydrogen production. For CO production, 205 represents a $CO_2$-containing stream, which also contains some amount of CO in some cases. Cathode exhaust is represented by stream 207, which contains the electrochemically generated $H_2$ or CO. Stream 207 may be sent to a separator, wherein hydrogen is separated from water or wherein carbon monoxide is separated from carbon dioxide. Stream 206 represents anode exhaust. In embodiments wherein carbon is the feedstock, the carbon dioxide in stream 206 is of sufficient purity that is sequestered or utilized (e.g., injected into a well) directly without further separation or purification.

In an embodiment, the reactor is operated at a temperature in the range of 600° C. to 1000° C. In an embodiment, the reactor is operated at a temperature in the range of 600° C. to 900° C. In an embodiment, the reactor is operated at a temperature in the range of 600° C. to 800° C.

Figure 3:
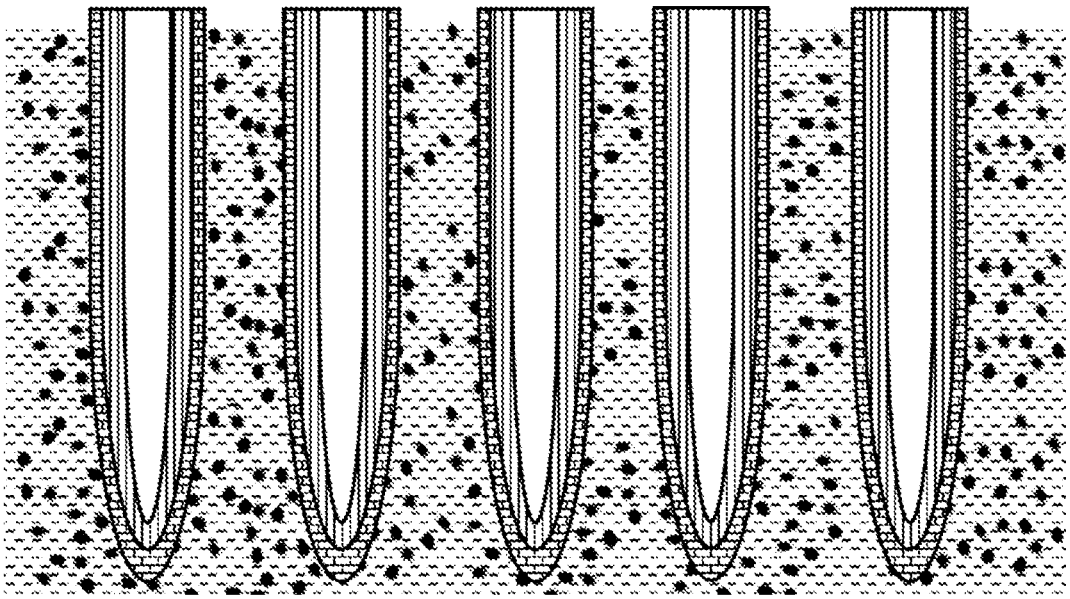
FIG. 3 illustrates a production system having multiple electrochemical reactor tubes, according to an embodiment of this disclosure.

As illustrated in FIG. 3, a $H_2$ or CO production system comprising multiple reactor tubes is shown, according to an embodiment of this disclosure. In some cases, these reactor tubes are connected in series for the cathode input and output. In some cases, these reactor tubes are connected in parallel for the cathode input and output. All suitable configurations and arrangements are contemplated and are within the scope of this disclosure. The cross section of the reactor tubes may be any suitable shape and is not limited by what is illustrated in FIG. 2 and FIG. 3.

Advantages

The process and system of $H_2$ or CO production according to this disclosure have various advantages. The process of this disclosure utilizes efficient electrochemical pathways but yet needs no electricity. As such, the implementation of this process may be in remote areas with no grid electricity supply. The separation of hydrogen from water in the cathode exhaust is easy and inexpensive. The separation of carbon monoxide from carbon dioxide in the cathode exhaust is also easy and inexpensive. As such, the method and system of this disclosure are cost competitive both in capital equipment and in operational expenses. The generated $H_2$ or CO or both may be further utilized to produce valuable products, such as methanol, ethanol, hydrocarbons, plastic monomers, polyethylene, or combinations thereof.

In addition, $H_2$ or CO generation from the feedstock as discussed herein as fuel is desirable because such fuel source is abundant and inexpensive. The produced carbon dioxide when carbon is utilized is of high purity and is easily sequestered, thus reducing greenhouse gas emission. Furthermore, the energy industry and steel industry currently send their waste around the globe to be burned into $CO_2$ and released to the atmosphere. The method and system of this disclosure enable the capture of carbon from waste streams that would otherwise be emitted to the environment while simultaneously producing clean, pure $H_2$ or CO or both. For example, a carbon-containing solid waste may be transported to a wellhead and converted onsite to carbon dioxide for direct injection, while $H_2$ or CO or both are produced simultaneously for clean energy consumers or for valuable chemical production.

It is to be understood that this disclosure describes exemplary embodiments for implementing different features, structures, or functions of the invention. Exemplary embodiments of components, arrangements, and configurations are described to simplify the present disclosure; however, these exemplary embodiments are provided merely as examples and are not intended to limit the scope of the invention. The embodiments as presented herein may be combined unless otherwise specified. Such combinations do not depart from the scope of the disclosure.

Additionally, certain terms are used throughout the description and claims to refer to particular components or steps. As one skilled in the art appreciates, various entities may refer to the same component or process step by different names, and as such, the naming convention for the elements described herein is not intended to limit the scope of the invention. Further, the terms and naming convention used herein are not intended to distinguish between components, features, and/or steps that differ in name but not in function.

While the disclosure is susceptible to various modifications and alternative forms, specific embodiments thereof are shown by way of example in the drawings and description. It should be understood, however, that the drawings and detailed description are not intended to limit the disclosure to the particular form disclosed, but on the contrary, the intention is to cover all modifications, equivalents and alternatives falling within the spirit and scope of this disclosure.

What is claimed is:

1. An electrochemical reactor comprising a first electrode, wherein the first electrode is liquid when the reactor is in operation, wherein the first electrode comprises lithium carbonate, potassium carbonate, sodium carbonate, or combinations thereof; a second electrode having a metallic phase and a ceramic phase, wherein the metallic phase is electronically conductive and wherein the ceramic phase is ionically conductive; and a membrane, wherein the membrane is positioned between the first and second electrodes and is in contact with the first and second electrodes, wherein the membrane is mixed conducting.

2. The reactor of claim 1, wherein the second electrode comprises Ni or NiO and a material selected from the group consisting of YSZ, CGO, SDC, SSZ, LSGM, CoCGO, and combinations thereof.

3. The reactor of claim 1, wherein the second electrode is porous.

4. The reactor of claim 1, wherein the second electrode is configured to reduce water to hydrogen electrochemically or to reduce carbon dioxide to carbon monoxide electrochemically.

5. The reactor of claim 1, wherein the first electrode is configured to carry a feedstock.

6. The reactor of claim 5, wherein the feedstock comprises carbon, ammonia, syngas, hydrogen, methanol, carbon monoxide, a hydrocarbon, biodiesel, renewable natural gas, biogas, biomass, biowaste, charcoal, petcoke, cooking oil, or combinations thereof.

7. The reactor of claim 1, wherein the first electrode is configured to oxidize a feedstock electrochemically.

8. The reactor of claim 1 comprising no interconnect and no current collector.

9. The reactor of claim 1 producing no electricity and receiving no electricity.

10. The reactor of claim 1, wherein the membrane comprises an electronically conducting phase and an ionically conducting phase.

11. The reactor of claim 10, wherein the electronically conducting phase comprises doped lanthanum chromite or an electronically conductive metal or combination thereof; and wherein the ionically conducting phase comprises a material selected from the group consisting of gadolinium or samarium doped ceria, yttria-stabilized zirconia (YSZ), lanthanum strontium gallate magnesite (LSGM), scandia-stabilized zirconia (SSZ), Sc and Ce doped zirconia (SCZ), and combinations thereof.

12. The reactor of claim 1, wherein the membrane comprises CoCGO or LST (lanthanum-doped strontium titanate)-stabilized zirconia.

13. The reactor of claim 12, wherein the stabilized zirconia comprises YSZ or SSZ or SCZ (scandia-ceria-stabilized zirconia), and wherein the LST comprises $LaSrCaTiO_3$.

14. The reactor of claim 1, wherein the membrane comprises Nickel, Copper, Cobalt, or Niobium-doped zirconia.

* * * * *